US007699442B2

(12) United States Patent
Lim et al.

(10) Patent No.: US 7,699,442 B2
(45) Date of Patent: Apr. 20, 2010

(54) PIEZOELECTRIC INKJET PRINTHEAD

(75) Inventors: Seung-mo Lim, Suwon-si (KR); Tae-kyung Lee, Suwon-si (KR); Chang-youl Moon, Suwon-si (KR); Jae-woo Chung, Yongin-si (KR); Hwa-sun Lee, Suwon-si (KR)

(73) Assignee: Samsung Electro-Mechanics Co., Ltd, Suwon-si (KR)

( * ) Notice: Subject to any disclaimer, the term of this patent is extended or adjusted under 35 U.S.C. 154(b) by 726 days.

(21) Appl. No.: 11/491,929

(22) Filed: Jul. 25, 2006

(65) Prior Publication Data

US 2007/0176980 A1 Aug. 2, 2007

(30) Foreign Application Priority Data

Feb. 1, 2006 (KR) ..... 10-2006-0009761

(51) Int. Cl.
*B41J 2/045* (2006.01)

(52) U.S. Cl. ..... 347/70; 347/68

(58) Field of Classification Search ..... 347/68–72
See application file for complete search history.

(56) References Cited

U.S. PATENT DOCUMENTS 5,355,158 A 10/1994 Inada et al.
5,748,214 A * 5/1998 Usui et al. ..... 347/70
5,907,340 A * 5/1999 Katakura et al. ..... 347/71

FOREIGN PATENT DOCUMENTS

DE 20313727 U1 1/2005
EP 0600743 6/1994
EP 0695638 2/1996
EP 1031422 8/2000
EP 1083048 3/2001
EP 1350625 10/2003
EP 1426185 6/2004
EP 1426485 6/2004
GB 2232933 1/1991

(Continued)

OTHER PUBLICATIONS

Japanese Office Action issued Jan. 29, 2009 in Japanese Application No. 2006-347857.

(Continued)

*Primary Examiner*—Stephen D Meier
*Assistant Examiner*—Geoffrey Mruk
(74) *Attorney, Agent, or Firm*—Stanzione & Kim, LLP

(57) ABSTRACT

A piezoelectric inkjet printhead includes a manifold, a chamber array including a plurality of chambers in connection with the manifold and arranged along at least one side of the manifold, a vibrating plate to cover the plurality of chambers, and a plurality of piezoelectric actuators formed on the vibrating plate to change pressures of corresponding ones of the plurality of chambers by vibrating the vibrating plate. The plurality of chambers includes a plurality of pressure chambers disposed in a center portion of the chamber array and having corresponding ink ejecting nozzles, and at least two dummy chambers, one disposed on each side of the chamber array and having corresponding dummy nozzles that do not eject ink. A plurality of trenches may be formed in the vibrating plate between each of the piezoelectric actuators.

12 Claims, 8 Drawing Sheets

FOREIGN PATENT DOCUMENTS

| | | |
|---|---|---|
| JP | 58-108163 | 6/1983 |
| JP | 01-178451 | 7/1989 |
| JP | 1-178451 | 7/1989 |
| JP | 3-284950 | 12/1991 |
| JP | 4-329145 | 11/1992 |
| JP | 04-361045 | 12/1992 |
| JP | 2004-209740 | 7/2004 |
| JP | 2004-262242 | 9/2004 |

OTHER PUBLICATIONS

European Search Report dated May 24, 2007 issued in European Patent Application No. 6252195.0.
European Search Report dated Aug. 10, 2007 issued in EP06252195.
European Search Report issued Dec. 23, 2009 in EP Application No. 06252195.0.

* cited by examiner

PIEZOELECTRIC INKJET PRINTHEAD

CROSS-REFERENCE TO RELATED APPLICATIONS

This application claims priority under 35 U.S.C. §119(a) from Korean Patent Application No. 10-2006-0009761, filed on Feb. 1, 2006, in the Korean Intellectual Property Office, the disclosure of which is incorporated herein in its entirety by reference.

BACKGROUND OF THE INVENTION

1. Field of the Invention

The present general inventive concept relates to a piezoelectric inkjet printhead, and more particularly, to a piezoelectric inkjet printhead that minimizes deviation of ink ejection performance caused by cross-talk.

2. Description of the Related Art

Generally, inkjet printheads are devices for printing a color image on a printing medium by ejecting droplets of ink onto a desired region of the printing medium. Depending on an ink ejecting method, inkjet printheads can be classified into two types: a thermal inkjet printhead and a piezoelectric inkjet printhead. The thermal inkjet printhead generates bubbles in ink to be ejected by using heat and ejects the ink utilizing an expansion of the bubbles, and the piezoelectric inkjet printhead ejects ink using a pressure generated by a deformation of a piezoelectric material.

FIG. 1 illustrates a general structure of a conventional piezoelectric inkjet printhead. Referring to FIG. 1, a manifold 2, a plurality of restrictors 3, a plurality of pressure chambers 4, and a plurality of nozzles 5 are formed in a flow channel plate 1 to form an ink flow channel. A piezoelectric actuator 6 is formed on a top area of the flow channel plate 1. The manifold 2 allows an inflow of ink from an ink tank (not illustrated), and the pressure chambers 4 are arranged along one side or both sides of the manifold 2 to store ink to be ejected. Each of the pressure chambers 4 is deformed by an operation of the piezoelectric actuator 6, such that ink can flow into or out of the pressure chamber 4 according to a pressure variation in the pressure chamber 4 caused by the operation of the piezoelectric actuator 6. The plurality of restrictors 3 connects the manifold 2 to corresponding ones of the plurality of pressure chambers 4.

Generally, the flow channel plate 1 is formed by individually manufacturing a silicon substrate and a plurality of thin metal or synthetic resin plates and by stacking the thin plates to form the ink channel portion. The piezoelectric actuator 6 is formed on top of the flow channel plate 1 above the pressure chamber 4 and includes a piezoelectric layer and an electrode stacked on the piezoelectric layer to apply a voltage to the piezoelectric layer. Therefore, a portion of the flow channel plate 1 forming an upper wall of the pressure chamber 4 functions as a vibrating portion 1*a* that is deformed by the piezoelectric actuator 6.

An operation of the conventional piezoelectric inkjet printhead will now be described. When the vibrating portion 1*a* (i.e., the portion of the upper wall of the pressure chamber 4 that functions as a vibrating portion 1*a*) is bent downward by the operation of the piezoelectric actuator 6, a volume of the pressure chamber 4 reduces, which increases a pressure inside the pressure chamber 4. Thus, ink is ejected from the pressure chamber 4 to outside of the printhead through the nozzle 5. When the vibrating plate 1*a* returns to its original shape according to the operation of the piezoelectric actuator 6, the volume of the pressure chamber 4 increases, which reduces the pressure of the pressure chamber 4. Thus, ink flows into the pressure chamber 4 from the manifold 2 through the restrictor 3.

However, in the conventional piezoelectric inkjet printhead, the pressure variation inside the pressure chamber 4 caused by the piezoelectric actuator 6 is also transmitted to neighboring pressure chambers 4. This phenomenon is called "cross-talk." The cross-talk causes deviations in a speed and volume of ink droplets ejected through the plurality of nozzles 5.

FIG. 2A is a graph illustrating an ink droplet ejecting speed with respect to nozzle position when the plurality of nozzles 5 are simultaneously operated in a conventional piezoelectric inkjet printhead, and FIG. 2B is a graph illustrating an ink droplet ejecting speed with respect to nozzle position when only nozzles disposed in region A of FIG. 2A are simultaneously operated in the conventional piezoelectric inkjet printhead.

For example, in a conventional piezoelectric inkjet printhead for forming a color filter, a plurality of nozzles is operated at the same time. In this case, as illustrates in FIG. 2A, the speed of ink droplets ejected through nozzles disposed at both sides of the printhead is lower than that of ink droplets ejected through nozzles disposed at a center portion of the printhead.

Referring to FIG. 2B, nozzles disposed at the center portion of the printhead (i.e., only the nozzles in the region A of FIG. 2A) are simultaneously operated, whereas the low-speed nozzles disposed at both sides of the printhead are not operated. In this case, the speed of the ink droplets ejected through the nozzles is also lower at both sides of the region A of the printhead than in the center portion of the region A of the printhead.

From the graphs illustrates in FIGS. 2A and 2B, it can be seen that the deviation of the ink ejecting speed is not caused by a non-uniform manufacturing of the nozzles between the center portion and the side portions of the printhead. Specifically, when the side portion nozzles are not operated, a deviation of the ink ejecting speed occurs between the center-most nozzles of the center portion and the outer-most nozzles of the center portion. However, this deviation is minimized or absent when the side portion nozzles are operated along with the center portion nozzles (although a deviation of the ink ejecting speed occurs between the side portion nozzles and the center portion nozzles, as discussed above).

An ink ejecting speed of a conventional piezoelectric inkjet print head can vary with respect to a nozzle position for a various reasons, including the following.

When a pressure of each pressure chamber increases by an operation of the piezoelectric actuator, ink inside the pressure chamber is ejected through a nozzle, and at the same time some of the ink is pushed in a reverse direction to the manifold through the restrictor. The reverse flow of the ink via the manifold influences neighboring pressure chambers, thereby increasing a pressure of the neighboring pressure chambers. In this case, pressure chambers disposed in a center portion of the printhead are affected by the reverse flow of the ink in pressure chambers on both sides thereof. However, the pressure chambers disposed at both sides of the printhead are affected by the reverse flow of the ink from one side thereof. Therefore, an ink ejecting pressure of the pressure chambers at both sides of the printhead is lower than that of the pressure chambers at the center portion of the printhead.

In the conventional inkjet printhead, a vibrating portion of pressure chambers is formed in one piece (i.e., there is no separate vibrating plate attached to the pressure chambers). Therefore, when one piezoelectric actuators vibrates, neighboring pressure chambers are affected by the vibration of the piezoelectric actuator through the vibrating portion. In this case, pressure chambers disposed in the center portion of the printhead are affected by vibrations from both sides thereof, and pressure chambers disposed at both sides of the printhead are affected by vibrations from one side thereof. Therefore, the ink ejecting pressure of the pressure chambers is lower at both sides of the printhead than at the center portion of the printhead.

As described above, in the conventional piezoelectric inkjet printhead, an ink ejecting performance of a plurality of nozzles varies due to cross-talk, thereby changing the speed and volume of ejecting ink droplets.

SUMMARY OF THE INVENTION

The present invention provides a piezoelectric inkjet printhead that minimizes ink-ejecting performance deviation caused by crosstalk.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a piezoelectric inkjet printhead including a manifold, a chamber array including a plurality of chambers to communicate with the manifold and arranged along at least one side of the manifold, at least one vibrating plate to cover the plurality of chambers, and a plurality of piezoelectric actuators formed on the at least one vibrating plate to change pressures of corresponding ones of the chambers by vibrating the at least one vibrating plate, the plurality of chambers includes a plurality of pressure chambers disposed in a center portion of the chamber array and having corresponding ink ejecting nozzles, and at least one dummy chamber disposed on a side portion of the chamber array and having a corresponding dummy nozzle which does not eject ink.

When the piezoelectric actuators operate, the pressure chambers may each eject ink through the ink ejecting nozzles and allow a reverse flow of the ink from the pressure chambers to the manifold, and the dummy chamber allows a reverse flow of ink from the at least one dummy chamber to the manifold but does not eject the ink through the corresponding dummy nozzle.

A diameter of the dummy nozzle may be smaller than diameters of the ink ejecting nozzles.

The manifold and the plurality of chambers may be formed in a flow channel plate, and the at least one vibrating plate may be formed on the flow channel plate. The piezoelectric inkjet printhead may further include a plurality of restrictors formed between the manifold and corresponding ones of the plurality of chambers.

The piezoelectric inkjet printhead may further include a plurality of trenches formed in the at least one vibrating plate between the piezoelectric actuators. The trenches may have a width of about 5 μm to about 10 μm.

The at least one vibrating plate may include a plurality of vibrating plates. A portion of the flow channel plate may be the at least one vibrating plate.

The foregoing and/or other aspects and utilities of the present general inventive concept may also be achieved by providing a piezoelectric inkjet printhead including a manifold, a plurality of pressure chambers to communicate with the manifold and arranged along at least one side of the manifold, a plurality of ink ejecting nozzles connected with corresponding ones of the plurality of pressure chambers, at least one vibrating plate to cover the pressure chambers, a plurality of piezoelectric actuators formed on the at least one vibrating plate to change pressures of corresponding ones of the pressure chambers by vibrating the at least one vibrating plate, and a plurality of trenches formed in the at least one vibrating plate between the piezoelectric actuators.

The trenches may prevent vibrations of the piezoelectric actuators from being transmitted to neighboring pressure chambers via the at least one vibrating plate.

The foregoing and/or other aspects and utilities of the present general inventive concept may also be achieved by providing a piezoelectric inkjet printhead, including a manifold, a chamber array comprising a plurality of ink chambers to communicate with the manifold and arranged along at least one side of the manifold, at least one vibrating plate to cover the plurality of ink chambers, a plurality of piezoelectric actuators formed on the vibrating plate to change pressures of corresponding ones of the plurality of ink chambers by vibrating the at least one vibrating plate, and a plurality of trenches formed in at least one of the at least one vibrating plate and the plurality of piezoelectric actuators between the plurality of piezoelectric actuators, and the plurality of ink chambers includes at least one dummy chamber disposed on a side portion of the chamber array and having a corresponding dummy nozzle which does not eject ink.

The foregoing and/or other aspects and utilities of the present general inventive concept may also be achieved by providing a piezoelectric inkjet printhead, including a flow channel plate, a vibrating plate to form a manifold, a pressure chamber, and a dummy chamber with the flow channel plate, and a plurality of actuators disposed to control the pressure chamber to generate a first back flow of ink toward the manifold and to control the dummy chamber to generate a second back flow of ink toward the manifold.

The flow channel plate may include a pressure nozzle formed thereon to correspond to the pressure chamber and a dummy nozzle formed thereon to correspond to the dummy chamber. The piezoelectric inkjet printhead may further include a pressure nozzle and a dummy nozzle to correspond to the pressure and dummy chambers, respectively, a portion of ink in the pressure chamber is ejected through the pressure nozzle and another portion of the ink in the pressure chamber moves to generate the first back flow of ink, and an entire portion of ink in the dummy chamber moves to generate the second back flow of ink.

The foregoing and/or other aspects and utilities of the present general inventive concept may also be achieved by providing a piezoelectric inkjet printhead, including a flow channel plate, a vibrating plate to form a manifold and chambers with the flow channel plate, a plurality of actuators disposed on the vibrating plate to control volumes of the chambers, and having a connection portion to connect adjacent actuators of the plurality of actuators and a trench formed on the connection portion.

The trench may be located between the adjacent actuators and has a predetermined depth. The vibrating plate may include a second connection portion to connect the adjacent actuators and a second trench formed on the second connection portion. The connection portion of the plurality of actuators may correspond to the second connection portion of the vibrating plate. The trench of the connection portion may correspond to the second trench of the second connection portion. The trench of the connection portion and the second trench of the second connection portion may be located between adjacent chambers formed by the vibrating plate and the flow channel plate. The trench of the connection portion and the second trench of the second connection portion may have a length that is longer than or equal to a length of the adjacent actuators.

The foregoing and/or other aspects and utilities of the present general inventive concept may also be achieved by providing a piezoelectric inkjet printhead, including a pressure chamber array comprising a plurality of ink ejecting chambers having corresponding ink ejecting nozzles, the ink ejecting nozzles having a diameter sufficiently large to eject ink, and a plurality of end pressure chambers comprising at least one end chamber located on a first end of the chamber array and at least one end chamber on a second end of the chamber array, each of the end chambers being without ink ejecting nozzles.

The plurality of end pressure chambers may include a plurality of first end chambers. The plurality of end pressure chambers may further include a plurality of second end chambers. A number of the plurality of first end chambers may equal a number of the plurality of second end chambers.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
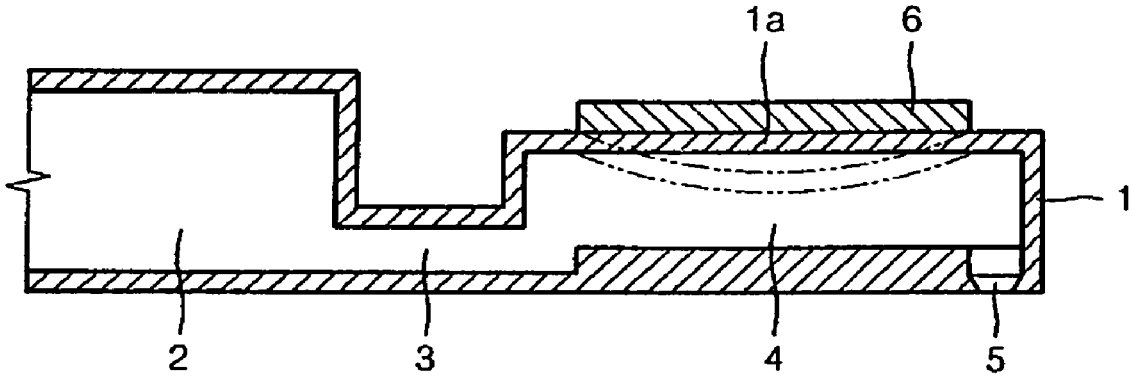
FIG. 1 (PRIOR ART)
FIG. 1 is a cross-sectional view illustrating a structure of a conventional piezoelectric inkjet printhead.
Figure 2A:
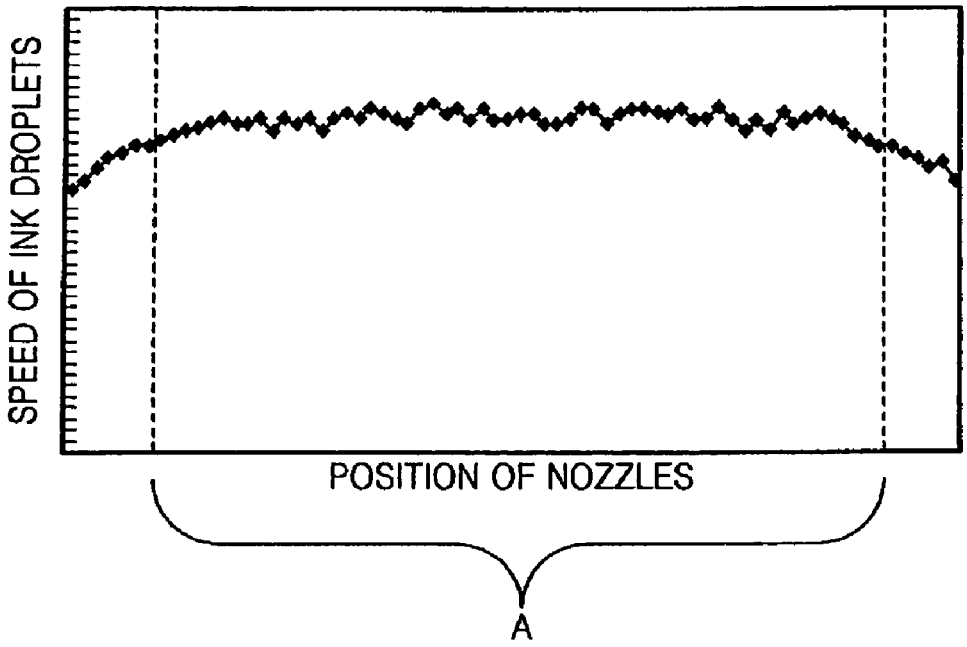
FIG. 2A (PRIOR ART)
FIG. 2A is a graph illustrating an ink droplet ejecting speed with respect to nozzle position when a plurality of nozzles are simultaneously operated in a conventional piezoelectric inkjet printhead.
Figure 2B:
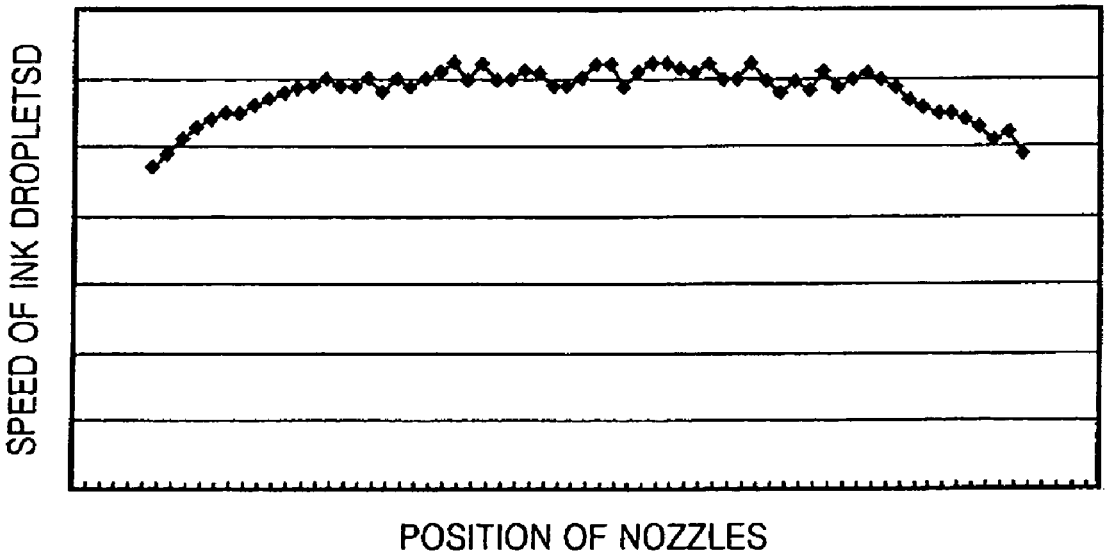
FIG. 2B (PRIOR ART)
FIG. 2B is a graph illustrating an ink droplet ejecting speed with respect to nozzle position when only the nozzles disposed in region A of FIG. 2A are simultaneously operated in the conventional piezoelectric inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. In addition, thicknesses of layers and regions are exaggerated for clarity.

Figure 3:
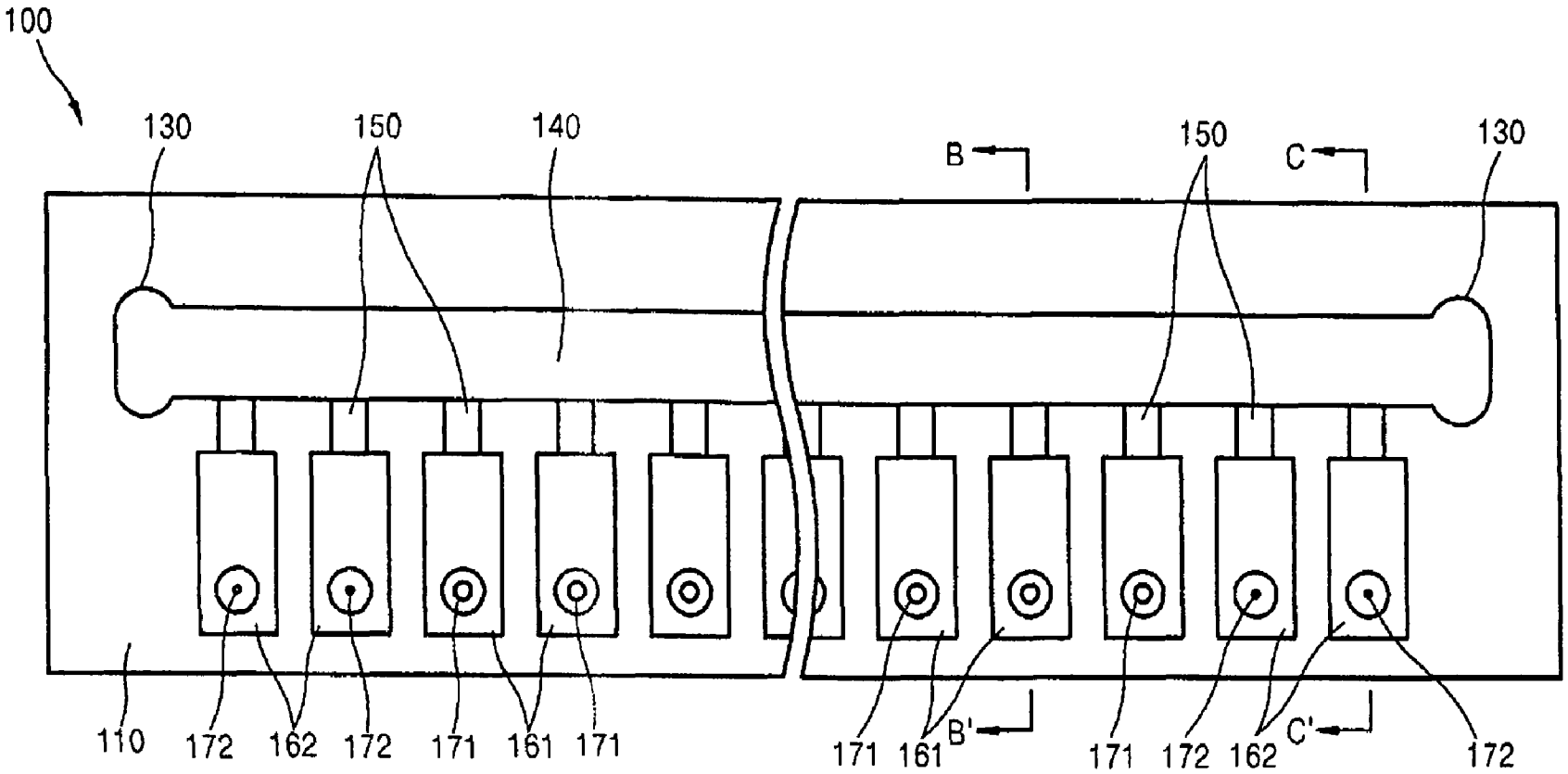
FIG. 3 is a plan view illustrating a piezoelectric inkjet printhead according to an embodiment of the present general inventive concept.
Figure 4A:
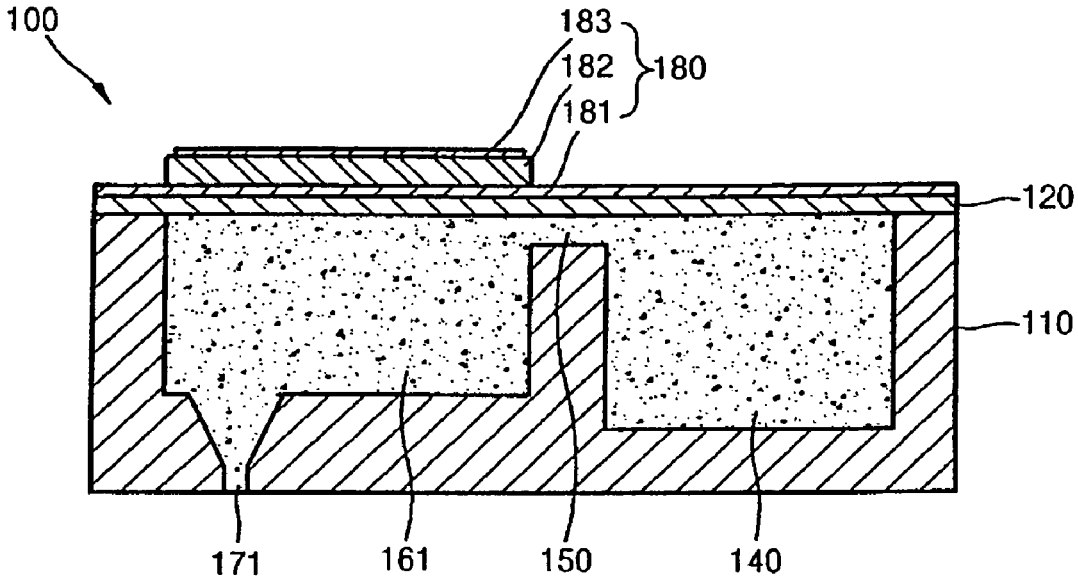
FIG. 4A is a vertical sectional view taken along line B-B' of the print head of FIG. 3.
Figure 4B:
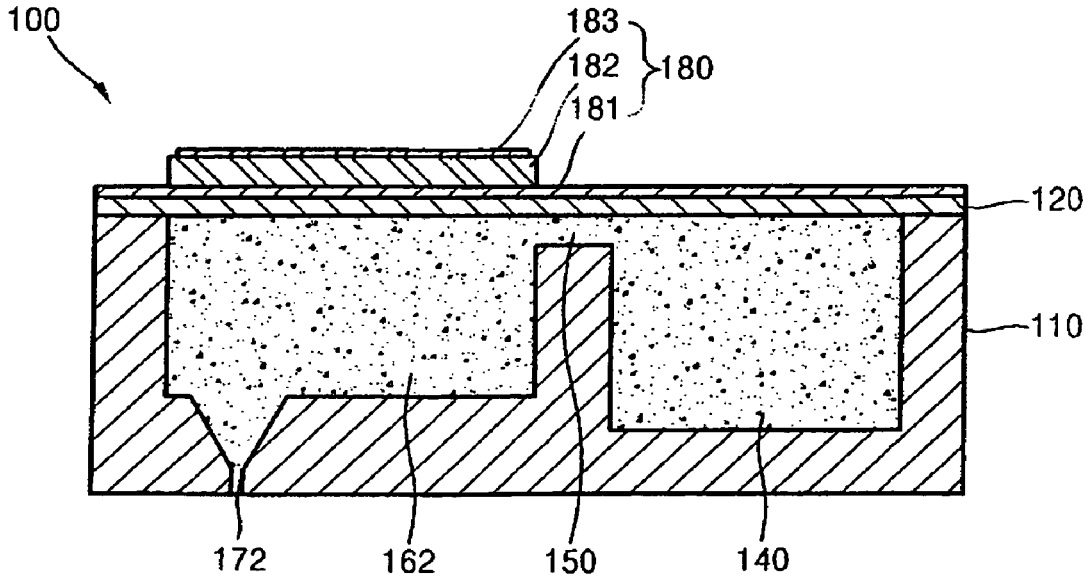
FIG. 4B is a vertical sectional view taken along line C-C' of the print head of FIG. 3.

FIG. 3 is a plan view illustrating a piezoelectric inkjet printhead 100 according to an embodiment of the present general inventive concept, FIG. 4A is a vertical sectional view taken along line B-B' of the printhead of FIG. 3, and FIG. 4B is a vertical sectional view taken along line C-C' of the printhead of FIG. 3.

Referring to FIGS. 3, 4A, and 4B, the piezoelectric inkjet printhead 100 includes an ink flow channel formed in a flow channel plate 110, a vibrating plate 120 formed on the flow channel plate 110, and a plurality of piezoelectric actuators 180 formed on the vibrating plate 120.

The ink flow channel includes a manifold 140 allowing an inflow of ink from an ink tank (not illustrated), a chamber array with a plurality of chambers 161 and 162 containing the ink supplied through the manifold 140, and a plurality of nozzles 171 and 172 connected with the plurality of the chambers 161 and 162. The manifold 140 is formed in a top area of the flow channel plate 110 to a predetermine depth, and may have an elongated shape in one direction. One side or each side of the manifold 140 may be connected with an ink inlet 130. The chamber array includes the plurality of chambers 161 and 162 formed on at least one side of the manifold 140 and connected with the manifold 140. Each of the chambers 161 and 162 is formed in the top area of the flow channel plate 110 to a predetermined depth and may have, for example, a rectangular parallel-piped shape elongated in a direction of ink flow. Meanwhile, the chamber array can be formed on both sides of the manifold 140. Further, a plurality of restrictors 150 can be formed between the manifold 140 and corresponding ones of the plurality of chambers 161 and 162. The nozzles 171 and 172 are formed through the flow channel plate 110 and are connected with corresponding ones of the chambers 161 and 162. Sizes of the manifold 140, the chambers 161 and 162, and the restrictors 150 may be determined based on a desired ink ejecting performance, such as a speed and volume of ejecting ink droplets.

The vibrating plate 120 is formed on the area top of the flow channel plate 110 to cover the chambers 161 and 162. The vibrating plate 120 may have a thickness of, for example, about 5 μm to about 13 μm. The thickness of the vibrating plate 120 may vary according to a desired driving force to eject the ink.

The piezoelectric actuators 180 are formed on the vibrating plate 120 to change the pressure inside the respective chambers 161 and 162 by vibrating the vibrating plate 120.

Each of the piezoelectric actuators 180 includes a lower electrode 181 (a common electrode), a piezoelectric layer 182 deformable in response to an applied voltage, and an upper electrode 183 as a driving electrode. The lower electrode 181 is formed on a top surface of the vibrating plate 120, and the piezoelectric layer 182 is formed on the lower electrode 181 above each of the chambers 161 and 162. The piezoelectric layer 182 may be formed of a piezoelectric material, such as a lead zirconate titanate (PZT) ceramic material. When a voltage is applied to the piezoelectric layer 182, the piezoelectric layer 182 is deformed, thereby bending the vibrating plate 120. The upper electrode 183 is formed on the piezoelectric layer 182 as a driving electrode to apply the voltage to the piezoelectric layer 182.

Although it has been described and illustrated that the inkjet printhead 100 of the present general inventive concept includes two plates, that is, the flow channel plate 110 and the vibrating plate 120, the inkjet printhead 100 of the present general inventive concept is not limited to the described and illustrated configuration. The illustrated configuration is merely an example of an embodiment of the present general inventive concept. It is possible that the vibrating plate 120 and the flow channel plate 110 may be formed in one piece. Further, the flow channel plate 110 may be formed by stacking and bonding a plurality of thin plates instead of using a single plate. Furthermore, the ink flow channel may have another different arrangement from the illustrated arrangement.

In the embodiment illustrated in FIG. 3, the chambers 161 of the chamber array are pressure chambers that eject ink, and the other chambers 162 are dummy chambers that only allow a reverse flow of the ink to the manifold 140 through the restrictors 150 from the chambers 162. The pressure chambers 161 are arranged in a center portion of the chamber array and include the nozzles 171 to eject ink therefrom. The dummy chambers 162 are disposed on both sides of the array chamber (at least one dummy chamber for each side of the array chamber) and include the nozzles 172 as dummy nozzles through which ink is not ejected. As illustrated in FIG. 3, two dummy chambers 162 may be disposed on each side of the chamber array. Alternatively, one, three, or more dummy chambers 162 may be disposed on each side of the chamber array.

The dummy chambers 162 may have, although are not required to have, the same size as the pressure chambers 161. However, whereas the ink ejecting nozzles 171 of the pressure chambers 161 have a diameter sufficiently large to eject a desired volume of ink droplets, the dummy nozzles 172 of the dummy chambers 162 have a diameter sufficiently small to prevent ink from being ejected therethrough when the piezoelectric actuators 180 operate.

When the piezoelectric actuators 180 operate, ink is ejected from the pressure chambers 161 through the ink ejecting nozzles 171, and some of the ink contained in the pressure chambers 161 is reversely pushed toward the manifold 140. The reverse flow of the ink from the pressure chambers 161 affects neighboring pressure chambers 161 and thus increases the pressure in the neighboring pressure chambers 161. However, when the piezoelectric actuators 180 operate, ink is not ejected from the dummy chambers 162 through the dummy nozzles 172, although ink is pushed in the reverse direction from the dummy chambers 162 toward the manifold 140. The reverse flow of the ink from the dummy chambers 162 also affects neighboring pressure chambers 161 and thus increases the pressure in the neighboring pressure chambers 161.

In this way, all the pressure chambers 161 are affected at both sides thereof by the reverse flow of the ink from neighboring pressure chambers 161 and/or the dummy chambers 162. That is, the pressure chambers 161 with the ink ejecting nozzles 171 are uniformly affected by cross talk. Therefore, ink can be uniformly ejected from the plurality of ink ejecting nozzles 171.

Figure 5:
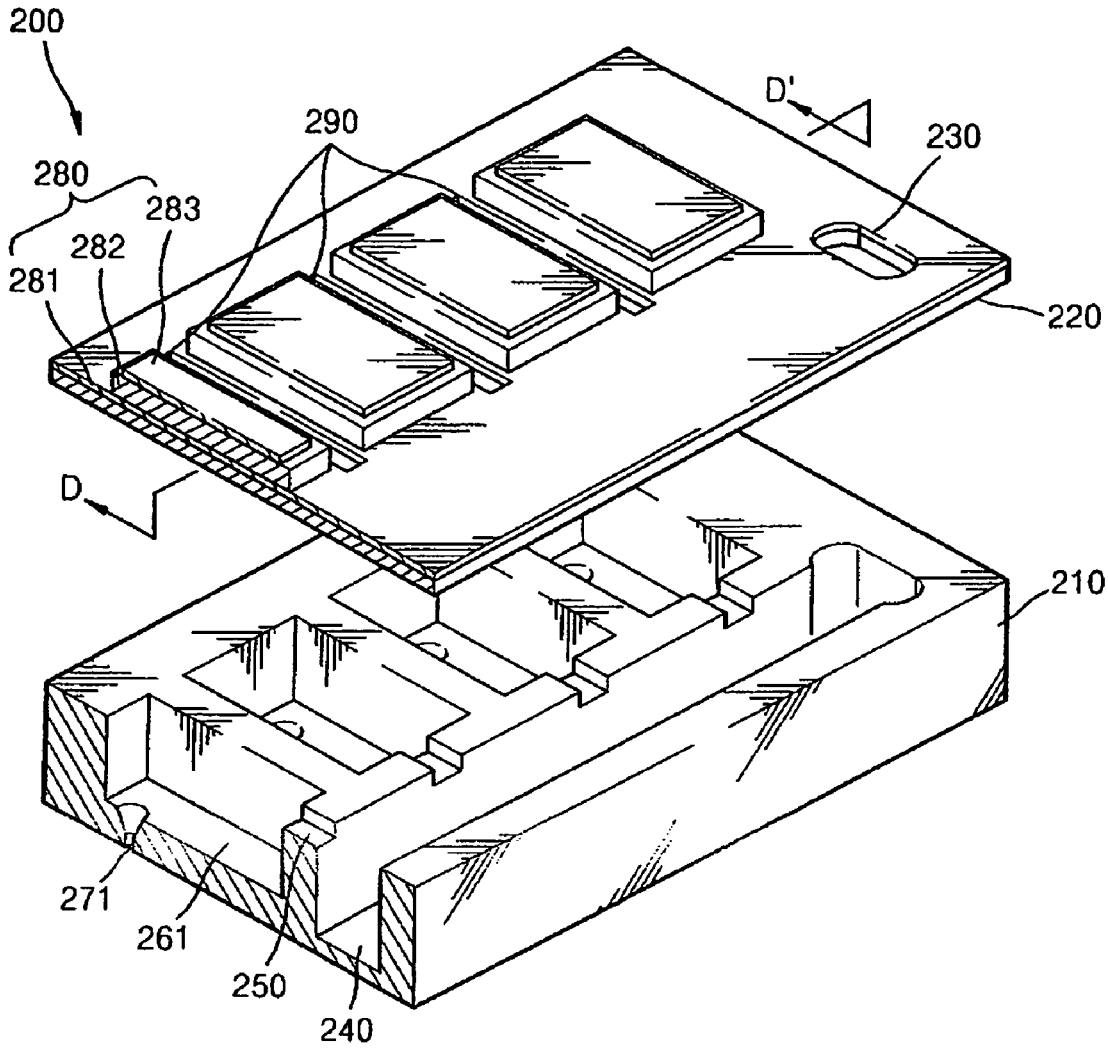
FIG. 5 is an exploded perspective view illustrating a piezoelectric inkjet printhead according to another embodiment of the present general inventive concept.
Figure 6:
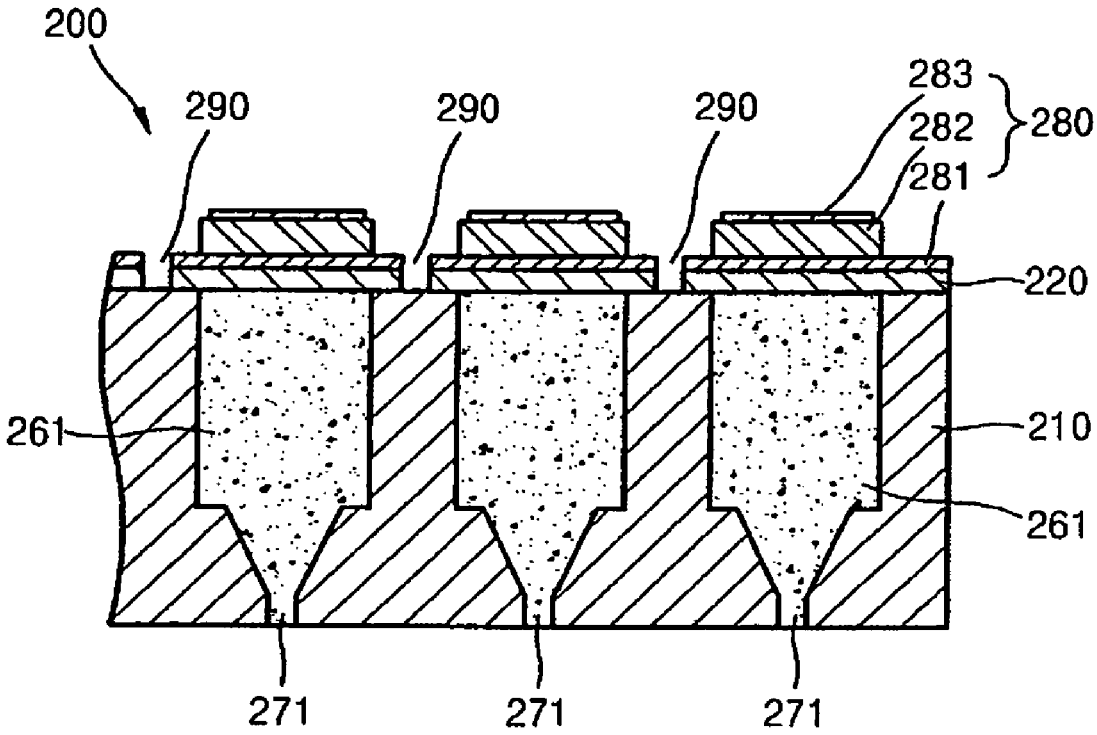
FIG. 6 is a vertical sectional view taken along line D-D' of the print head of FIG. 5.

FIG. 5 is an exploded perspective view illustrating a piezoelectric inkjet printhead 200 according to another embodiment of the present general inventive concept, and FIG. 6 is a vertical sectional view taken along line D-D' of the printhead of FIG. 5.

Referring to FIGS. 5 and 6, the piezoelectric inkjet printhead 200 includes a flow channel plate 210 formed with an ink flow channel having a manifold 240, a plurality of restrictors 250, a plurality of pressure chambers 261, and a plurality of nozzles 271; a vibrating plate 220 formed on the flow channel plate 210 to cover the plurality of pressure chambers 261; and a plurality of piezoelectric actuators 280 formed on the vibrating plate 220. The vibrating plate 220 is formed with an ink inlet 230 connected to the manifold 240. However, the vibrating plate 220 may be formed with two or more ink inlets 230 connected to the manifold 240. Each of the piezoelectric actuators 280 includes a lower electrode 281 formed on a top area of the vibrating plate 220 as a common electrode, a piezoelectric layer 282 formed on the lower electrode 281 above the pressure chamber 261 and deformable in response to an applied voltage, and an upper electrode 283 formed on the piezoelectric layer 282 as a driving electrode.

The piezoelectric inkjet printhead 200 of the present embodiment has many of the same elements as the piezoelectric inkjet printhead 100 of the embodiment illustrated in FIG. 3. Thus, descriptions of these elements will be omitted. However, unlike the piezoelectric inkjet printhead 100 of the embodiment illustrated in FIG. 3, the piezoelectric inkjet printhead 200 of the present embodiment does not include the dummy chambers 162 and the dummy nozzles 172. That is, all the ink chambers of the piezoelectric inkjet printhead 200 are pressure chambers 261 to eject ink.

In the present embodiment, the vibrating plate 220 is formed with a plurality of trenches 290 between the piezoelectric actuators 280. Each of the trenches 290 has a width of about 5 μm to about 10 μm and may be elongated in a length direction of the piezoelectric actuator 280, for example, a direction of the ink flowing from the manifold 240 to the ink chambers 261 through a passage of the restrictors 350. Each of the trenches 290 may have a length equal to or slightly longer than that of the piezoelectric layer 282 of the piezoelectric actuator 280. The trenches 290 are formed on at least one of a portion of the piezoelectric actuators 280 and a portion of the vibrating plate 220, as illustrated in FIGS. 5 and 6. Remaining portions of the piezoelectric actuators 280 and the vibrating plate 220 other than the trench formed portion may be referred to as a "connecting portion" to connect the vibrating plate 220 and the piezoelectric actuators 280.

The plurality of trenches 290 effectively prevents vibrations of each of the piezoelectric actuators 280 from being transmitted to neighboring pressure chambers 261 via the vibrating plate 220. Therefore, a driving power of the piezoelectric actuators 280 can be uniformly transmitted to the respective pressure chambers 261, and thus ink can be uniformly ejected through the nozzles 271 of the pressure chambers 261.

Figure 7:
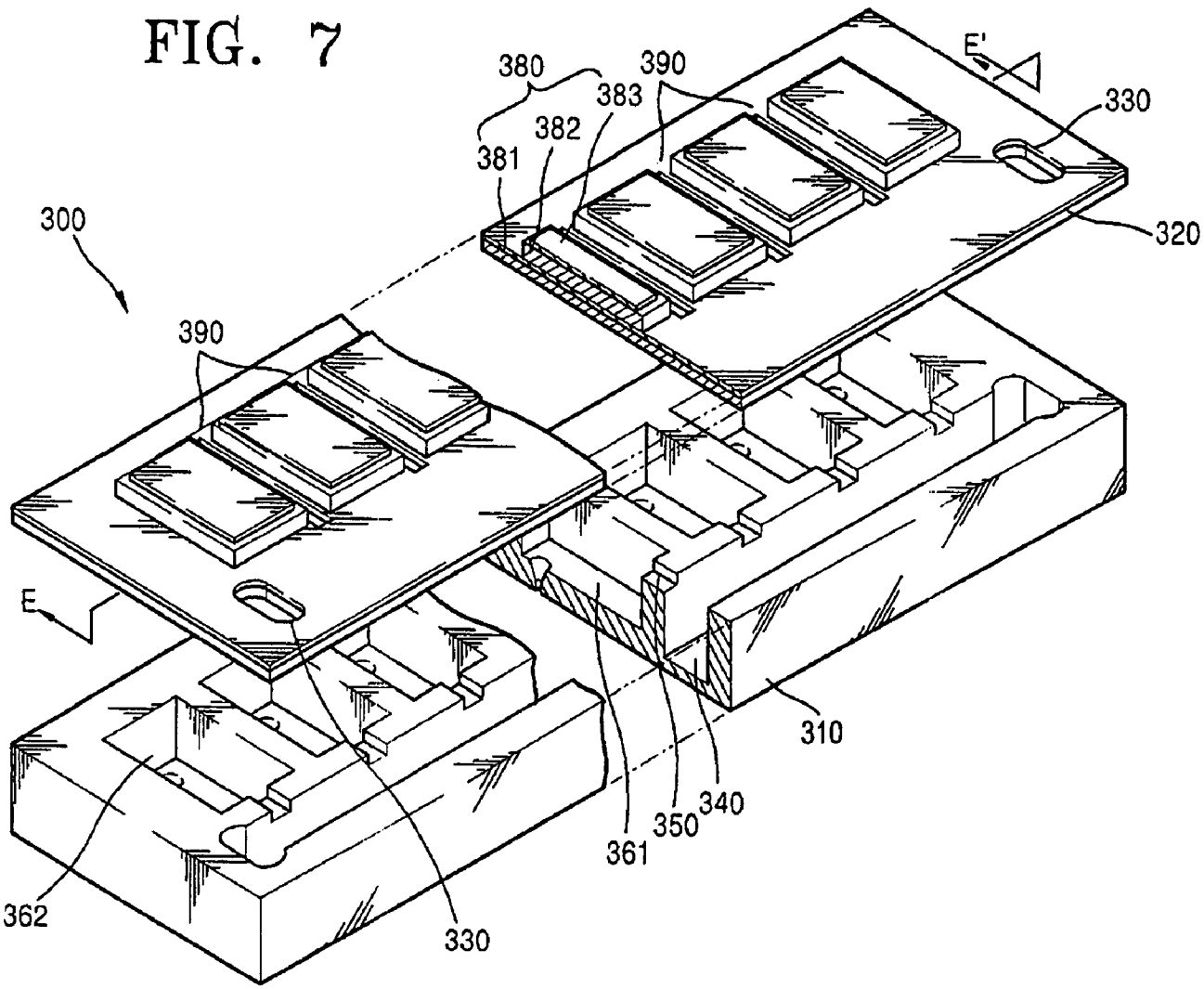
FIG. 7 is an exploded perspective view illustrating a piezoelectric inkjet printhead according to another embodiment of the present general inventive concept.
Figure 8:
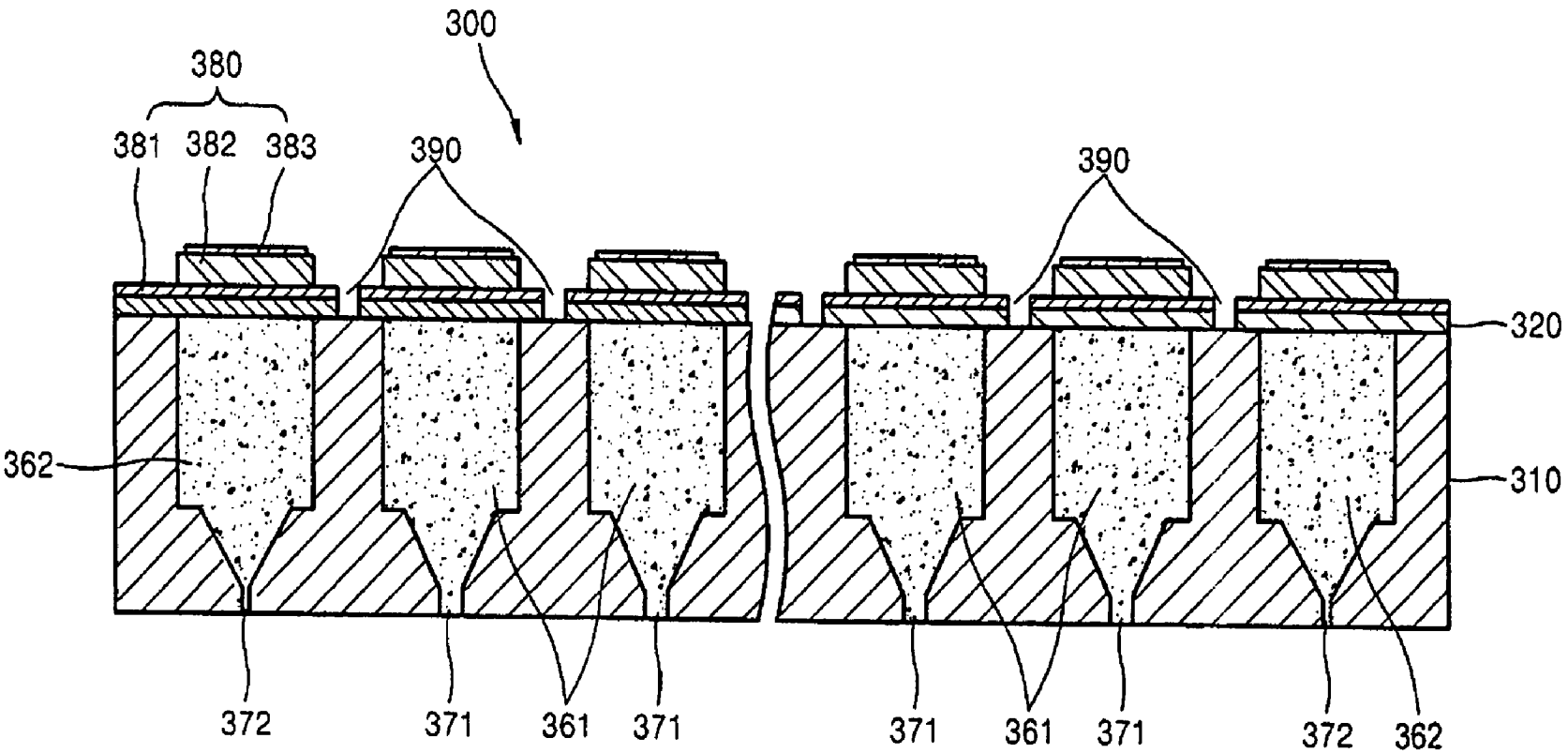
FIG. 8 is a vertical sectional view taken along line E-E' of the print head of FIG. 7.

FIG. 7 is an exploded perspective view illustrating a piezoelectric inkjet printhead 300 according to another embodiment of the present general inventive concept, and FIG. 8 is a vertical sectional view taken along line E-E' of the printhead of FIG. 7.

Referring to FIGS. 7 and 8, the piezoelectric inkjet printhead 300 of the present embodiment is configured to have the characteristic features of both the piezoelectric inkjet printhead 100 illustrated in FIG. 3 and the piezoelectric inkjet printhead 200 illustrated in FIG. 5.

Specifically, the piezoelectric inkjet printhead 300 includes a flow channel plate 310 formed with an ink flow channel including a manifold 340, a plurality of restrictors 350, a chamber array having a plurality of chambers 361 and 362 containing ink supplied from the manifold 340, and a plurality of nozzles 371 and 372 connected with the plurality of chambers 361 and 362; a vibrating plate 320 formed on the flow channel plate 310 to cover the plurality of chambers 361 and 362; a plurality of piezoelectric actuators 380 formed on the vibrating plate 320; and a plurality of trenches 390 formed in the vibrating plate 320 between the piezoelectric actuators 380. The vibrating plate 320 is formed with ink inlets 330 connected to the manifold 340. Each of the piezoelectric actuators 380 includes a lower electrode 381 formed on a top of the vibrating plate 320 as a common electrode, a piezoelectric layer 382 formed on the lower electrode 381 above each of the chambers 361 and 362 and deformable in response to an applied voltage, and an upper electrode 383 formed on the piezoelectric layer 382 as a driving electrode.

As described above, the piezoelectric inkjet printhead 300 of the present embodiment has many of the same elements as the piezoelectric inkjet printheads 100 and 200 of the embodiments illustrated in FIGS. 3 and 5. Thus, descriptions of these elements will be omitted.

In the piezoelectric inkjet printhead 300 of the present embodiment, the chambers 361 of the chamber array are pressure chambers that eject ink, and the other chambers 362 of the chamber array are dummy chambers that only allow reverse flow of the ink to the manifold 340 through the restrictors 350 from the chambers 362. The pressure chambers 361 are arranged in a center portion of the chamber array and include the nozzles 371 as ink ejecting nozzles to eject ink. The dummy chambers 362 are disposed on both sides of the chamber array (at least one dummy chamber for each side of the chamber array) and include the nozzles 372 as dummy nozzles through which ink is not ejected. Further, the vibrating plate 320 includes the trenches 390 between the piezoelectric actuators 380.

The dummy chambers 362, the dummy nozzles 372, and the trenches 390 may provide the same functions and effects as described above. However, the piezoelectric inkjet printhead 300 of the present embodiment has the characteristic features of both embodiments respectively illustrated in FIGS. 3 and 5. Therefore, ink can be ejected from the nozzles 371 more uniformly.

As described above, according to the present general inventive concept, pressure chambers of a piezoelectric inkjet printhead are arranged in a center portion of a chamber array thereof, and dummy chambers are disposed at both sides of the chamber array, so that pressure chambers having ink ejecting nozzles can be subjected to uniform cross talk. Further, trenches formed in a vibrating plate prevent vibrations of piezoelectric actuators from being transmitted to neighboring pressure chambers via the vibrating plate, so that ink can be uniformly ejected through the plurality of ink ejecting nozzles.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric inkjet printhead, comprising:

a manifold;

a chamber array including a plurality of chambers to communicate with the manifold and arranged along at least one side of the manifold;

at least one vibrating plate to cover the plurality of chambers; and a plurality of piezoelectric actuators formed on the at least one vibrating plate to change pressures of corresponding ones of the chambers by vibrating the at least one vibrating plate, wherein the plurality of chambers includes a plurality of pressure chambers disposed in a center portion of the chamber array and having corresponding ink ejecting nozzles, and at least one dummy chamber disposed on a side portion of the chamber array and having a corresponding dummy nozzle which does not eject ink, wherein the at least one dummy chamber allows a reverse flow of ink from the at least one dummy chamber to the manifold but does not eject the ink through the corresponding dummy nozzle when at least one of the piezoelectric actuators corresponding to the at least one dummy chambers operates.

2. The piezoelectric inkjet printhead of claim 1, wherein when the piezoelectric actuators operate, the pressure chambers each eject ink through the ink ejecting nozzles and allow a reverse flow of the ink from the pressure chambers to the manifold.

3. The piezoelectric inkjet printhead of claim 1, wherein a diameter of the dummy nozzle is smaller than diameters of the ink ejecting nozzles.

4. The piezoelectric inkjet printhead of claim 1, wherein the manifold and the plurality of chambers are formed in a flow channel plate, and the at least one vibrating plate is formed on the flow channel plate.

5. The piezoelectric inkjet printhead of claim 4, wherein a portion of the flow channel plate is the at least one vibrating plate.

6. The piezoelectric inkjet printhead of claim 1, further comprising:

a plurality of restrictors formed between the manifold and corresponding ones of the plurality of chambers.

7. The piezoelectric inkjet printhead of claim 1, further comprising:

a plurality of trenches formed in the at least one vibrating plate between the piezoelectric actuators.

8. The piezoelectric inkjet printhead of claim 7, wherein the trenches have a width of about 5 μm to about 10 μm.

9. The piezoelectric inkjet printhead of claim 1, wherein the at least one vibrating plate comprises a plurality of vibrating plates.

10. A piezoelectric inkjet printhead, comprising:

a flow channel plate;

a vibrating plate to form a manifold, a pressure chamber, and a dummy chamber with the flow channel plate; and a plurality of actuators disposed to control the pressure chamber to generate a first back flow of ink toward the manifold and to control the dummy chamber to generate a second back flow of ink toward the manifold without ejection of ink when an actuator corresponding to the dummy chamber operates.

11. The piezoelectric inkjet printhead of claim 10, wherein the flow channel plate comprises:

a pressure nozzle formed thereon to correspond to the pressure chamber; and a dummy nozzle formed thereon to correspond to the dummy chamber.

12. The piezoelectric inkjet printhead of claim 10, further comprising:

a pressure nozzle and a dummy nozzle to correspond to the pressure and dummy chambers, respectively, wherein:

a portion of ink in the pressure chamber is ejected through the pressure nozzle and another portion of the ink in the pressure chamber moves to generate the first back flow of ink, and an entire portion of ink in the dummy chamber moves to generate the second back flow of ink.

* * * * *